United States Patent [19]

Kitts, Jr.

[11] Patent Number: 4,755,447

[45] Date of Patent: Jul. 5, 1988

[54] ENHANCED RADIOGRAPHIC IMAGE CAPTURE USING A WIDE-DYNAMIC-RANGE FILM

[75] Inventor: Earle L. Kitts, Jr., Hendersonville, N.C.

[73] Assignee: E. I. Du Pont de Nemours and Company, Wilmington, Del.

[21] Appl. No.: 915,131

[22] Filed: Oct. 3, 1986

Related U.S. Application Data

[63] Continuation-in-part of Ser. No. 657,252, Oct. 3, 1984, abandoned.

[51] Int. Cl.[4] ..... G03C 1/02; G03C 5/17

[52] U.S. Cl. ..... 430/139; 430/567; 430/966

[58] Field of Search ..... 430/567, 139, 966

[56] References Cited

U.S. PATENT DOCUMENTS

| | | | |
|---|---|---|---|
| 3,989,527 | 11/1976 | Locker | 96/69 |
| 4,013,471 | 3/1977 | Pollet et al. | 96/663 |
| 4,049,454 | 9/1977 | Van Doorselaer et al. | 96/55 |
| 4,373,022 | 2/1983 | Hoffman et al. | 430/434 |
| 4,413,353 | 11/1983 | Macovski et al. | 378/62 |
| 4,446,228 | 5/1984 | Honda et al. | 430/567 |

OTHER PUBLICATIONS

Radiology, vol. 81, No. 2, Aug. 1963, pp. 201–206, "Evaluation of a Computer-Retrieved Radiographic Image".

Radiology, vol. 81, No. 2, Aug. 1963, pp. 185–200, "The Coding of Roentgen Images for Computer Analysis as Applied to Lung Cancer".

Technical Report No. 32-1028 (NASA), "Digital Computer Processing of X-Ray Photographs", R. H. Selzer, Nov. 15, 1966.

Alvarez et al., Diagnostic Imaging, May 1983, pp. 36–41.

Sensitometric Properties of X-Ray Films, published by Eastman Kodak Co., 1963, pp. 2–32.

Principles of Substraction in Radiology, published by Du Pont, pp. 1–10.

"Curix ®RP1 Film", pamphlet published by Agfa-Gevaert Rex, Inc., 1982.

Pamphlets on Cronex ®6 Plus and Cronex ®7, published by Du Pont.

*Primary Examiner*—Richard L. Schilling

[57] ABSTRACT

A wide-dynamic-range wide latitude silver halide film is used for X-ray intensifying screen exposure and subsequent computer enhancement of the images produced thereon. The enhanced image is equivalent to images produced by a host of individual films and screens.

5 Claims, No Drawings

ENHANCED RADIOGRAPHIC IMAGE CAPTURE USING A WIDE-DYNAMIC-RANGE FILM

CROSS REFERENCE TO RELATED APPLICATION

This is a continuation-in-part of application Ser. No. 657,252, filed Oct. 3, 1984 now abandoned.

BACKGROUND OF THE INVENTION

1. Field of the Invention

This invention relates to the field of radiography and specifically to an improved silver halide film element useful therein. More specifically, this invention relates to radiographic film elements exposed in conjunction with intensifying screens and to an improved system which employs the techniques of computer and film enhancement of images produced thereby.

2. Background Art

The use of computer enhancement of photographic images is widely known and used in the field of space research, for example. Here, pictures transmitted to earth from outer space are enhanced with the aid of a computer and the image reconstructed to reproduce the detail distorted by the transmission thereof. Many attempts have been made to use this process in the field of radiography, i.e., medical X-ray.

In the field of radiography, it is common practice to employ light emanating from X-ray intensifying screens to expose photographic silver halide film employed therewith. The X-ray exposure source excites the phosphor in the screen which then emits light to which the silver halide film is sensitive. Radiologists require a sufficiently high-gradient medical X-ray film to obtain good visibility of subtle image detail. Because there is only a limited range of optical densities useful for radiographic diagnosis, the requirement of medium to high film contrast limits the exposure latitude to such an extent that important information is frequently lost in the toe or shoulder of the film response.

It was thought that electronic imaging techniques which would digitize X-ray images from conventional films and attempt to computer-enhance these images would be able to provide diagnostic information over a much wider range of exposures than could be achieved with conventional medical X-ray film. However, such electronic imaging techniques have not been widely used due to many factors. The image processing appeared to reduce the overall visibility of the image and radiologists were afraid to trust the results. The conversion of the photographic information to digital information that could be handled by the computer increased the so-called noise of the entire system and it was suspected that clinical information would be lost. All of these prior art systems of electronic imaging employed conventional film/screen combinations designed for use in a conventional radiological system, one wherein the developed image is examined visually directly from the film. But there are a host of film/screen systems each designed for a specific purpose. For example, high contrast films are needed for the examination of anatomical components such as bone while films with lower contrast are needed for the examination of soft tissue. Film/screen speeds also vary depending on the exposure desired. Thus, it could be seen that conventional systems are not adaptable to computer enhancement.

SUMMARY OF THE INVENTION

It is an object of this invention to provide a medical X-ray system employing intensifying screens and silver halide photographic elements which can be adapted to computer or analog film enhancement of images produced thereon. It is a further object to produce a film useful in computer-enhanced medical X-ray applications that can be used over a wide latitude of exposures and yet produce a satisfactory final image.

These and other objects are achieved in a procedure, or several procedures, for capturing radiographic information over a very wide exposure latitude on a low-contrast, wide-dynamic-range medical X-ray screen film; subsequently the film-image is enhanced by analog or digital image processing to provide adequate contrast in selected regions for good detail visibility. More specifically, the invention is directed to a process wherein photosensitive silver halide film is imagewise exposed to light emanating from an X-ray intensifying screen to form a latent image thereon, said image is developed with a suitable photographic developer therefor, and subsequently said developed image is enhanced by digital or analog processing to provide additional contrast in selected regions of said image, characterized in that the process employs as the photosensitive silver halide film a wide-dynamic-range film with exposure latitude of $\geqq 10:1$ having a $\Delta$Log E between 1.0 and 3.0, whereby good visibility of the radiographic detail over a wider exposure latitude is obtained. In this process one film can be used for almost all of the radiographic exposure ranges and the image enhanced by a computer so as to recover the useful information contained therein.

DETAILED DESCRIPTION OF THE INVENTION

Digital processing requires conversion of the analog film image to a digital electronic image to allow computer processing. The enhanced image is displayed on a video monitor to allow the user to control the computer processing. Analog processing can be accomplished by at least two methods using film. The simplest method is to copy the original low-contrast radiograph by contact printing onto a medium- to high-contrast ($\gamma > 1$) direct-positive duplicating film. Another analog method is to use the wide-dynamic-range film for image capture in image subtraction procedures. A high-contrast subtraction print film can then be used to restore desired image contrast in the final subtracted image used for diagnosis. These techniques provide good visibility of radiographic detail over a much wider exposure latitude than can be achieved with conventional film/screen systems.

In the practice of this invention, a photographic silver halide emulsion is provided in which a mixture of silver halide grains is employed so as to produce a wide exposure range. Two or more emulsions, each with a different average grain size, may be used. It is preferable to use three emulsions with volume-weighted mean volumes (as measured by an Electronic Grain Size Analyser) of 0.06, 0.20 and 1.20 $(\mu m)^3$ respectively to achieve a $\Delta$Log E of between 1.0 and 3.0. In the preferred embodiment the grains are mixed at 26% of the 0.06 $(\mu m)^3$ size, 16% of the 0.2 $(\mu m)^3$ size and 58% of the 1.2 $(\mu m)^3$ size respectively to achieve an optimum $\Delta$Log E of 1.7, within the range of useful film densities. The average gradient of this film is about 1.6 with the gradient remaining fairly constant over almost all of the entire range of useful densities (i.e. D=0.3 to 3.0, for example). One only needs to select the optimum mixture of grains to achieve the gradient desired to produce the effects of this invention. What is surprising is that this film, with its relatively low gradient, can be used in the computer-enhanced system to produce radiographic results over an extraordinarily broad range of patient exposures.

By way of explanation and clarification, the most common method for describing the performance of a photographic system is to plot density against the logarithm of the exposure, e.g., as described in The Theory of the Photographic Process, Fourth Edition, Macmillan Publishing Co., Inc., New York, 1977, pp. 501–508 (See particularly FIG. 17.27 on page 501). According to this invention, a useful density range of 0.3 to 3.0 is selected for practical reasons. For example that portion of the sensitometric curve above density of 3.0 is not considered useful because information cannot be read efficiently by either current laser scanners or the human eye. The densities below 0.3 on the sensitometric curve are attributable to sources other than the photographic emulsion, e.g., film base. Between the stated useful density range, the sensitometric curve exhibits an essentially constant gradient, i.e., the photographic response is essentially linear, preferably over a large portion of the curve in the useful density range. The essentially constant gradient has a value of no greater than 2.0, preferably between 1.0 and 2.0, at density values within the range of 0.3 and 3.0. In calculating the $\Delta$Log E, within the stated density range over which the gradient is essentially constant, only that portion of the curve may be used in which the maximum gradient exceeds the minimum gradient by no more than a factor of two, e.g., when the maximum gradient is 2 then no portion of the curve wherein the gradient is less than 1 could be used in calculating the $\Delta$Log E over which the curve has essentially constant gradient. Gradient as used herein means the slope of the curve plotting density as a function of logarithm of exposure, i.e., dD/d (log E)=gamma (gradient).

The silver halides can be made by any conventional process (e.g. "splash", single jet, or balanced double jet). Either a splash or single jet process is preferred because of the broader grain-size distribution achieved by this method. The silver halide may be any of the conventional halides (e.g. bromide, chloride or iodide or mixtures thereof). Silver bromoiodide of ca. 98% bromide and ca. 2% iodide is preferred. It can be prepared in gelatin or other conventional binders or supplements thereto (e.g. polyvinyl alcohol, etc.). The preferred binder is gelatin, either dextran or modified-hydrolysed gelatin (see Rakoczy, U.S. Pat. No. 3,778,278) to increase covering power. These emulsions can be sensitized using any of the conventional sensitizers (e.g. gold, sulfur, etc.) and may also contain the usual after-additions (e.g. antifoggants, coating and wetting aids, hardeners, etc.). Additionally, if so desired, these emulsions may contain spectral sensitizers so as to be responsive to light emitted by certain intensifying screens (e.g. green emitters). But it is preferred that these emulsions not be so sensitized and be responsive mainly in the blue region of the spectrum. The emulsions can be mixed in the desired ratios and coated on any of the conventional photographic supports, preferably polyethylene terephthalate suitably tinted (e.g. with a blue dye) and subbed (subcoated). The emulsions may also be over-coated with a conventional antiabrasion layer, e.g. a thin layer of hardened gelatin.

In a conventional X-ray examination the patient, or object to be X-rayed, is interposed between an X-ray source and a cassette wherein the film is exposed to light which originated as X-rays prior to passage through one or more intensifying screens. After exposure, the film is removed and the latent image contained therein is developed in standard developers (e.g. mixed hydroquinone and phenidone, for example), fixed, washed and dried. The resulting image has low contrast but should contain all the radiographic information necessary to the viewer. The image is further processed (typically filtered, restored and enhanced) by a computer. The electronics involved may be analog or digital. To further understand the process one can image the photographic image divided into a checker board of discrete, small squares, for example. Each square may be numbered corresponding to the grey level (lightness or darkness) contained therein. These numbers, organized according to the X-Y Cartesian coordinates in the image plane, form the so-called digital image.

Once the digitized image is formed, a computer takes over the information and the image may be reconstructed and enhanced using this device. For example, a physician observing an X-ray image, said image having been digitized and processed by computer as described above, can project this image on a video screen, for example. Then, using the proper image processing program, he can enhance certain areas of the picture on the screen to see if more radiological information is available. When the desired image is obtained, this image may be stored in the computer or hard copy made by any of the conventional and known methods. Thus, a single, wide latitude, wide-dynamic-range film, made according to the teachings of this invention, can be used in this process to replace a myriad of films and screens used in the prior art. This can produce superior radiographic information.

In a specific example of this invention, three silver bromoiodide emulsions (98% $Br^-$ and 2% $I^-$) were made by the splash precipitation method. Emulsion A had a volume-weighted mean volume of 0.06 $(\mu m)^3$ (as measured by an Electronic grain Size Analyser) while Emulsion B had a mean volume of 0.20 $(\mu m)^3$ and that of Emulsion C was 1.20 $(\mu m)^3$. These emulsions were precipitated in a minimal amount of gelatin and then were mixed at 26% of A, 16% of B and 58% of C, respectively. The mixed emulsion was then redispersed in bulk gelatin (ca. 160 g of gel/1.5 moles of silver halide) with calcium hydroxide (ca. 4 mg/g of gelatin) added to provide greater sensitization latitude. Gold salts, thiocyanate, mercury and thionex were added to bring the emulsion to its optimum sensitivity. The emulsion was then cooled and the usual wetting agents, surfactants, chelating agents, stabilizers, antistats and antifoggants added as is well-known to those skilled in the art of making X-ray emulsions. The emulsion was then coated on a 7 mil polyethylene terephthalate film support. The support as made containing a minor amount of a blue dye to impart a blue tint thereto and, prior to emulsion coating, had been subcoated on both sides with a conventional sub layer followed by a thin, anchoring substratum of gelatin. Total silver coating weight was about 5.2 g $Ag/m^2$. The emulsion was coated on both sides of this support at a coating weight of 2.6 g $Ag/m^2$ on each side, and a hardened gelatin antiabrasion layer (ca. 10 mg $gel/dm^2$) was applied over each emulsion layer. The dried film was then tested by X-ray exposure as described above. The speed of this film with a standard intensifying screen (e.g. Du Pont Quanta® III) was equivalent to a high speed medical X-ray film-screen system (e.g. Du Pont Cronex®7 with Quanta® III screens), a speed 400 at a net density of 1.0. The average gradient was 1.6 and was nearly constant over the entire range of useful densities (e.g. D=0.30 to D=3.00). The dynamic range of this film was ca. 50X with a ΔLog E of 1.7 compared to ca. 8X and ΔLog E of 0.9 for conventional radiographic film. The exposed film was then processed in a digital radiographic system as described above.

Excellent results were achieved and it was possible to enhance the image and observe high quality diagnostic information contained therein while practicing the process taught above. This was not achievable using conventional radiographic films.

In a like manner, films were made with mixtures of emulsions (up to four in number) to achieve films with ΔLog E between 1.0 and 3.0. Good results were obtained.

What is claimed is:

1. In a process wherein a photosensitive silver halide film is imagewise exposed to light emanating from an X-ray intensifying screen to form a latent image thereon, followed by developing said image and subsequently enhancing said developed image by analog or digital computer processing to provide additional contrast in selected regions of said image, the improvement comprising employing as the photosensitive silver halide film a wide-dynamic-range film with exposure latitude of ≧10:1 and within a useful density range of 0.3 to 3.0 having an essentially constant gradient of no greater than 2.0 and the maximum gradient never exceeds the minimum gradient by more than a factor of two within said density range and a ΔLog E between 1.0 and 3.0 for the essentially constant gradient, whereby visibility of the radiographic detail over a wide exposure latitude is obtained.

2. The process of claim 1 wherein three silver halide emulsions are mixed, and wherein the emulsion grain size distribution is such that their volume-weighted mean volumes are 0.06, 0.20, and 1.20 $(\mu m)^3$.

3. The process of claim 1 wherein the optimum ΔLog E=1.7.

4. The process of claim 1 wherein the digital process uses a CRT screen for displaying the image.

5. The process of claim 1 wherein the specific analog process uses subtraction print film or duplicating film to enhance the image captured on the wide-dynamic-range film element.

* * * * *